US005997160A

United States Patent [19]

Swanson

[11] Patent Number: 5,997,160

[45] Date of Patent: Dec. 7, 1999

[54] PROTECTED HALOGEN LAMP

[75] Inventor: Dennis K. Swanson, Woodland Hills, Calif.

[73] Assignee: Lamps Plus, Inc., Chatsworth, Calif.

[21] Appl. No.: 08/727,935

[22] Filed: Oct. 9, 1996

[51] Int. Cl.[6] ..... F21V 15/00

[52] U.S. Cl. ..... 362/376; 362/414; 362/276; 362/802; 362/375

[58] Field of Search ..... 362/375, 376, 362/410, 414, 431, 276, 802, 294, 373, 374

[56] References Cited

U.S. PATENT DOCUMENTS

| | | | |
|---|---|---|---|
| 1,923,970 | 8/1933 | Dowling | 362/376 |
| 2,469,412 | 5/1949 | Roebken | 362/376 |
| 4,635,172 | 1/1987 | Steinke | 362/276 |
| 4,694,223 | 9/1987 | Campolo | 362/276 |
| 4,751,623 | 6/1988 | Gaines et al. | 362/276 |
| 4,751,624 | 6/1988 | Russo et al. | 362/276 |
| 4,959,762 | 9/1990 | Soileau | 362/376 |
| 5,099,404 | 3/1992 | Kenum | 362/263 |
| 5,221,141 | 6/1993 | Swanson | 362/250 |
| 5,519,594 | 5/1996 | Wu | 362/223 |
| 5,725,303 | 3/1998 | Lin | 362/376 |

*Primary Examiner*—Thomas M. Sember
*Attorney, Agent, or Firm*—Fulbright & Jaworski L.L.P.

[57] ABSTRACT

A stand alone electric lamp for illumination which includes a tungsten-halogen bulb as the illuminating member. The lamp includes a support member, an upwardly directed open pan affixed to the support member in which the tungsten-halogen light bulb is disposed, a protector member disposed over the open pan to prevent foreign objects from coming into contact with the tungsten-halogen light bulb and a thermally activated switch. The protector member is substantially transparent to light from the tungsten-halogen bulb to allow light therefrom to pass through the protector member in a substantially unobstructed fashion. The thermally activated switch is disposed within the open pan for interruption of the application of electrical energy to the tungsten-halogen light bulb when temperatures at the protector member reaches a predetermined level. The thermally activated switch may be a one time operational device which functions in the manner of a fuse, a manually resettable switch, or a switch which pivots from off to on as the temperature drops from the predetermined level at which it becomes open to a lesser level. The switch preferably incorporates a thermal sensor such as a thermistor or alternatively may be a bimetal disc or a linear bimetal unit depending upon the particular application desired.

25 Claims, 4 Drawing Sheets

FIG. 2
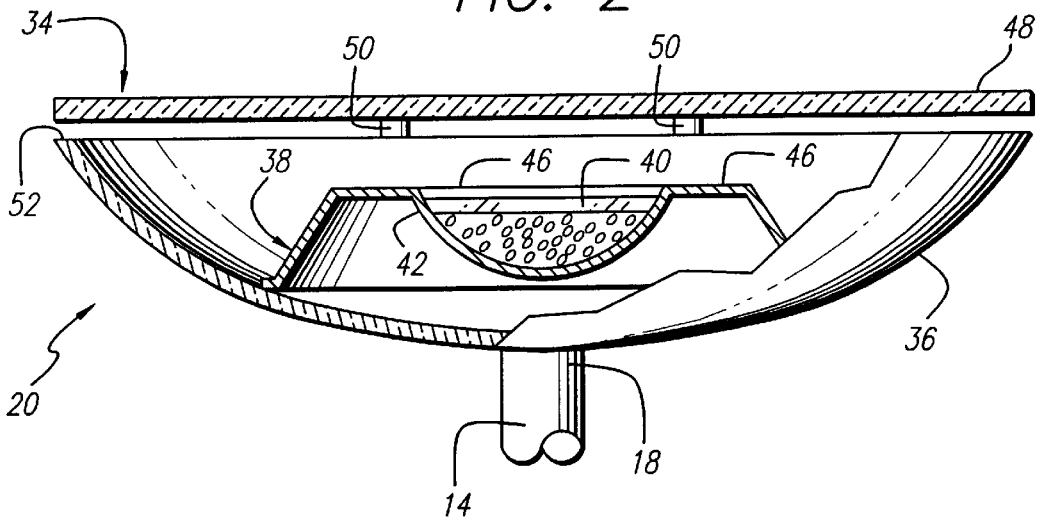
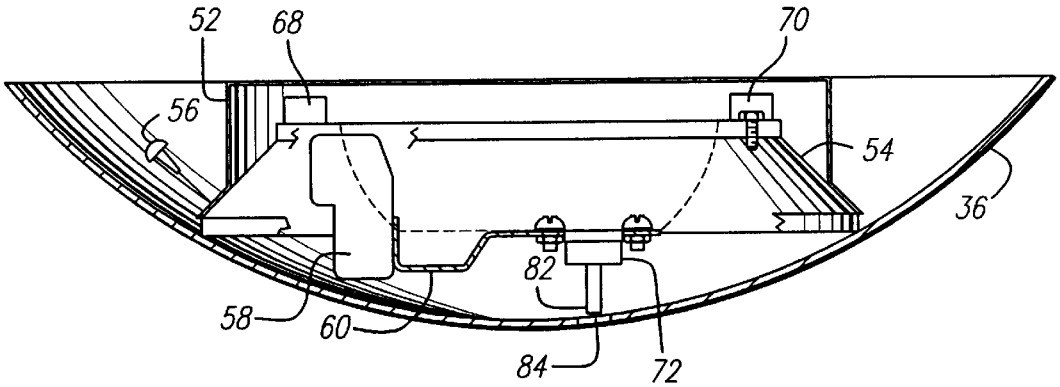
FIG. 3

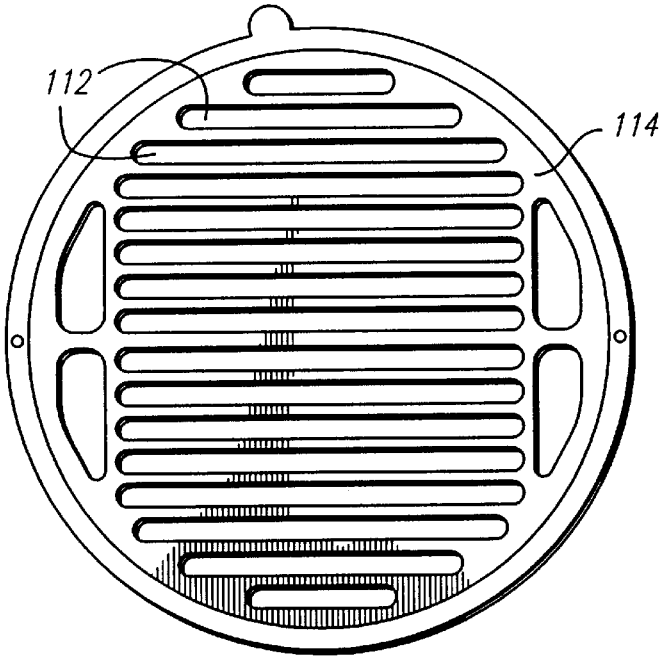
FIG. 9
FIG. 10
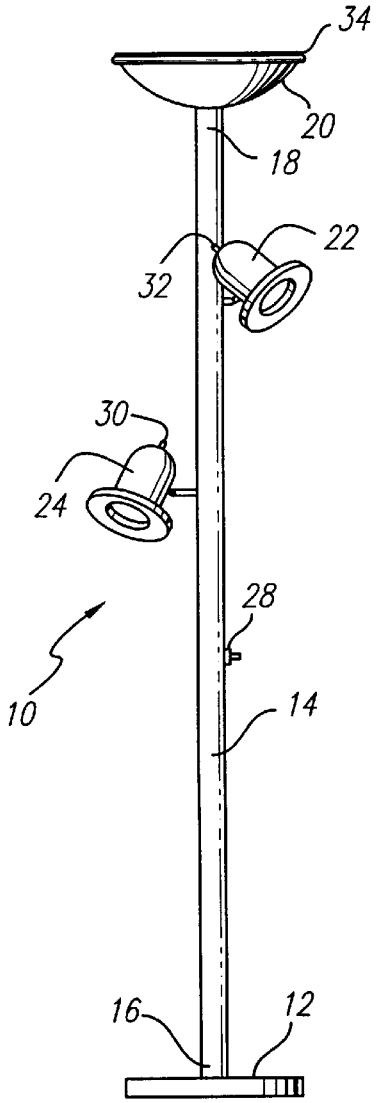

PROTECTED HALOGEN LAMP

BACKGROUND OF THE INVENTION

1. Field of the Invention

The present invention relates generally to electric lighting apparatus and more particularly, to such apparatus which includes a halogen light bulb therein, which bulb is disposed in a pan-like member that may be open and subject to having foreign objects placed thereon.

2. Description of the Related Art

Electric lighting apparatus in the form of floor lamps and table lamps is well known. Such lamps generally take the form of a general area lighting device or, alternatively, a task lighting device. A general lighting apparatus is one which provides lighting for a predetermined area without particular concern for directing the light for reading, highlighting specific items such as paintings or the like or otherwise. On the other hand, task lighting focuses the light through the utilization of reflector members for a specific purpose such as reading, to highlight a given area to accent some item such as a sculpture, painting or the like. An example of task lighting structures are the well known pole lamps or track lighting structures.

The present invention is particularly directed to such lighting apparatus which utilizes general lighting as at least a portion thereof. Such apparatus may also include task lighting or alternatively, it may have no task lighting of any type. In recent history, a tremendous volume of general lighting-type lighting equipment, both with and without task lights, have been sold. A large number of such general lighting devices have incorporated as the illumination element thereof a halogen bulb. Such halogen bulbs in units having an open top design with the bulb facing upward have under certain circumstances generated hazardous conditions in that cloth which has inadvertently or purposefully been placed over has ignited causing fires.

SUMMARY OF THE INVENTION

A stand alone electric lamp including a tungsten-halogen bulb as the illuminating member which lamp includes a support means, said lamp comprising an upwardly directed open pan affixed to the support means and in which a tungsten-halogen light bulb is disposed. And a protector means disposed over the open pan to prevent foreign objects from coming into contact with the tungsten-halogen light bulb. The protector means being substantially transparent to light from the tungsten-halogen bulb to allow light therefrom to pass through the protector means in a substantially unobstructed fashion.

In accordance with a more specific aspect of the present invention, the lamp also includes a thermally activated switch means disposed within the open pan for interruption of the application of electrical energy to the tungsten-halogen light bulb when temperatures at the protector means reaches a predetermined level. The thermally activated switch means may be a one time operational device which functions in the manner of a fuse, a manually resettable switch, or a switch which pivots from off to on as the temperature drops from the predetermined level at which it becomes open to a lesser level. The switch means preferably incorporates a thermal sensor such as a thermistor or alternatively may be a bimetal disc or a linear bimetal unit depending upon the particular application desired.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 2 is a partial cross-sectional view of the open pan containing the tungsten-halogen bulb, taken about the lines 2—2 of FIG. 1;

FIG. 3 is a partial cross-sectional view illustrating further details of the structure as shown in FIG. 2 with a protector device affixed to a reflector pan contained within the open pan;

FIG. 9 is a top view of a protector device constructed in accordance with another alternative embodiment of the invention; and FIG. 10 is a perspective view illustrating another example of a stand alone electric lamp which may be constructed in accordance with the principals of the present invention.

DETAILED DESCRIPTION OF THE INVENTION

Figure 1:
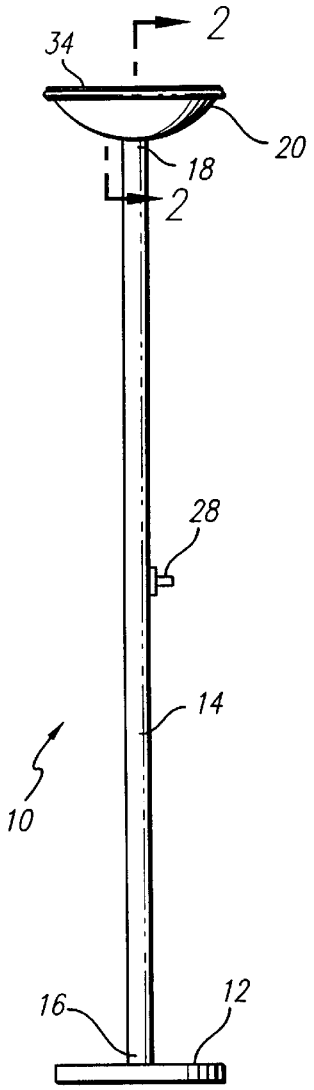
FIG. 1 is a perspective view illustrating one example of a stand alone electric lamp which may be constructed in accordance with the principals of the present invention.

As illustrated in the drawings and more particularly in FIG. 1, there is provided a stand-alone lamp 10 having a base 12 from which extends a hollow stem 14. The stem has a first end 16 which is rigidly and permanently affixed to the base 12 at approximately the center thereof. A second end 18 of the stem 14 is affixed to a general area lighting means 20 with the stem 14 being permanently affixed thereto at approximately the central portion thereof.

Electrical wiring (not shown) extends through the hollow stem 14 and provides electrical energy to lamps which are disposed within the general purpose lighting means 20. Switch means 28 are provided to individually control the application of electrical energy to the lighting sources disposed within the lighting means 20. The switch 28 is utilized to control the light source in the general purpose lighting means 20 and functions as a stem-mounted full dimmer switch which can turn the lamp in the general purpose lighting means 20 off and on as well as from full dim to full bright. A protector means 34 is affixed to the open pan of the general area lighting means 20.

More and additional details of structure of the type above-described can be found in U.S. Pat. No. 5,221,141, issued Jun. 22, 1993 to the Applicant of this application. The disclosure contained in U.S. Pat. No. 5,221,141 is therefore incorporated herein by reference.

Figure 7:
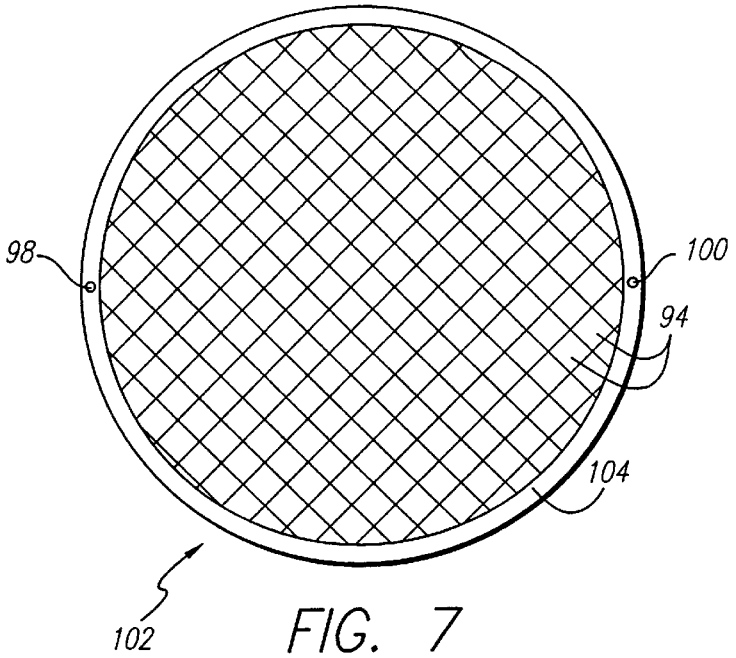
FIG. 7 is a top view of a protector device which may be affixed to the open pan as shown in FIG. 4 constructed in accordance with the principals of the present invention.
Figure 8:
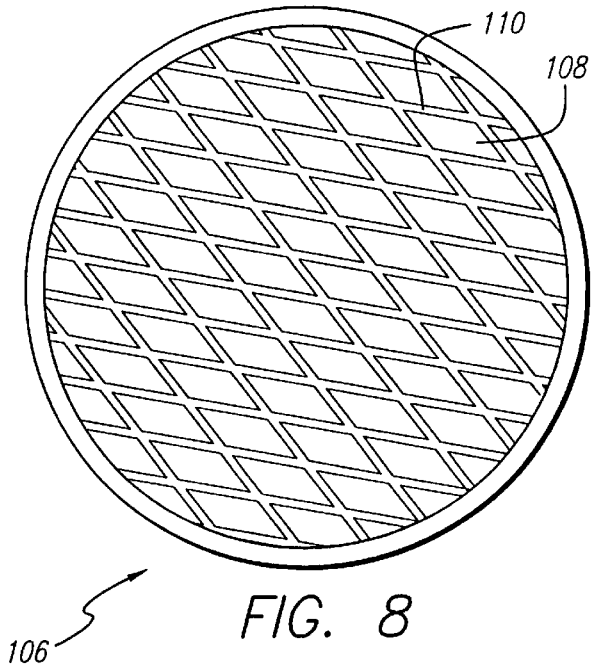
FIG. 8 is a top view of a protector device constructed in accordance with an alternative embodiment of the invention.
Figure 6:
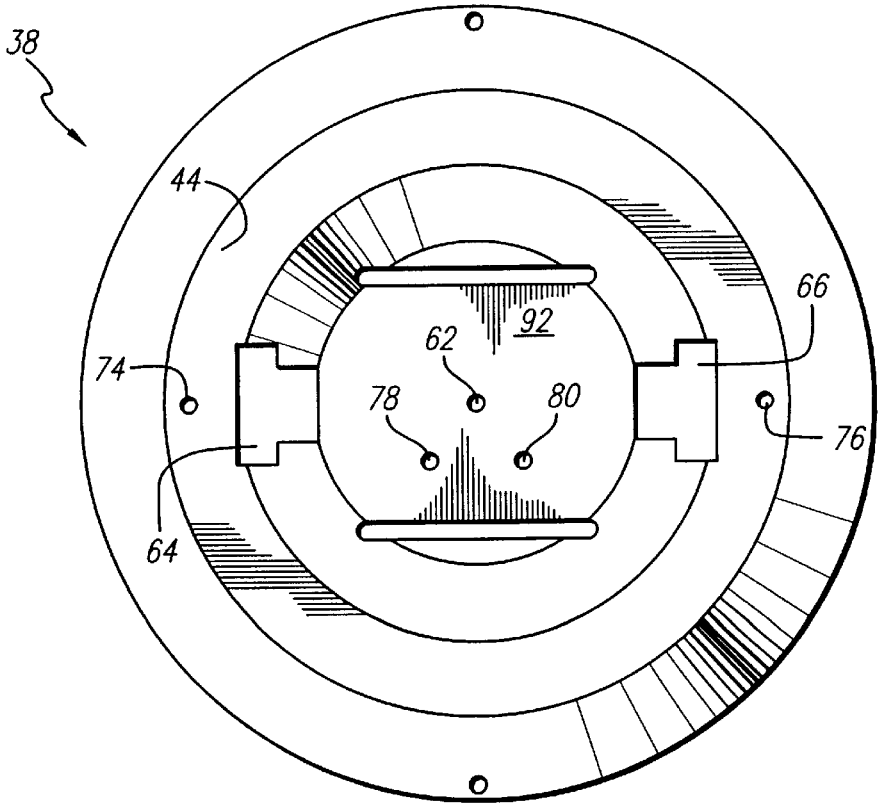
FIG. 6 is a bottom view of a reflector pan.

By reference now more specifically to FIG. 2, there is therein shown in greater detail the general area lighting means 20 includes an upwardly directed open pan shaped member 36. Typically disposed within the pan shaped member 36 is a reflector pan 38 which may be secured to the innersurface of the open pan 36 by fasteners, adhesive or other means well known to those skilled in the art. A tungsten-halogen bulb 40 is supported within a depressed or bowl shaped area 42 of the reflector pan 38. As is illustrated in FIGS. 2 and 6, the reflector pan 38 includes an annular ridge 44, a protective shield 46 is disposed over the tungsten-halogen light bulb 40 as is well known to those skilled in the art. The protector means 34 may take various forms. One embodiment of such a form is as illustrated at 48 and includes a disc of glass which may be supported by appropriate attachment means such as standoffs 50 which are secured to the lower surface of the glass disc and to a lip 52 of the open pan 36. The glass disc 48 may be heat tempered glass or other such glass which will withstand the heat generated by the tungsten-halogen bulb 40. Alternatively, the glass disc 48 may be of the type which transmits light therethrough so as to properly illuminate the area as is required by general area lighting means, but which at the same time reflects the heat generated by the tungsten-halogen bulb downwardly back into the surface of the open pan 36. In this manner, the heat generated by the tungsten-halogen light bulb 40 does not have the effect of potentially creating fire if a fabric is allowed to fall upon or be placed over the glass 48. Alternatively, the protector means 34 may be constructed of a wire mesh structure 102 which may also be supported upon the lip 52 of the upwardly directed open pan 36 and one embodiment of such a structure will be described herein below with respect to FIG. 7. Other alternatives include an expanded metal structure 106 as shown in FIG. 8 and a metallic grate-like member 106 as shown in FIG. 9.

By reference now, and more specifically to FIG. 3, there is shown an alternative embodiment of a protector means for utilization in conjunction with the lighting means of the present invention. As is therein shown, there is provided a metal grill-like structure 52 which is supported upon an outer surface 54 of the reflector pan 38. The grill-like member 52 is secured to the outer surface 54 by fasteners such as illustrated at 56. As is illustrated in FIG. 3, there is provided socket means 58 supported by the reflector pan 38 for receiving the tungsten-halogen bulb 40. The socket means 58 (only one of which is shown) is attached to an appropriate bracket 60 which is held in place on the bottom surface of the reflector pan 38 as is shown more specifically in FIG. 6. As is therein illustrated, a fastener such as screw or the like is inserted through the opening 62 and engages the bracket 60 so that the socket such as shown at 58 may be held in place at the openings 64 and 66 in the reflector pan 38.

It has also been found that thermally activated switches may be very useful in conjunction with the electric lighting equipment in accordance with the principals of the present invention. Such thermally activated switches may be disposed at various positions within the open pan 36 in such a manner that the temperature at the top of the protector member 34 does not reach a predetermined level. Predetermined level of temperature is that temperature at which combustion is likely to occur with regard to fabric which has been placed either inadvertently or purposefully upon the upper surface of the open pan. The protector means will preclude the fabric from coming into direct contract with the tungsten-halogen bulb 40, however, additional precautions must be taken so that the temperature level at the protector means does not rise to the level to provide combustion. UL Laboratories, Inc. has set forth a test identified as Appendix A "Adopted Requirements and Established Effective Date for the Eleventh Edition of the Standard For Portable Electric Lamps, UL-153," dated Aug. 2, 1996 and effective Feb. 5, 1997 which describes a test by which lighting equipment of the type above described can be approved. As therein indicated, the test includes the placing of bleached cheesecloth having a count of 32 by 28 over the top of the open pan in such a manner that it drapes over the edge. If after seven hours of testing with an appropriate tungsten-halogen bulb there is no combustion nor holes formed in the cheesecloth, then the unit is acceptable. Therefore, if the temperature at the upper surface of the protector means reaches a level where holes are formed or combustion occurs with respect to such cheesecloth then the unit is unsatisfactory.

If a thermally activated switch placed within the pan 36 operates to interrupt the application of electrical power to the bulb 40 prior to the time the temperature reaches the level as above described, then the lighting equipment will not create a hazard of any type. To accomplish this, it has been found that such thermally activated switches may be disposed, for example, as illustrated at 68 and 70, in angularly displaced positions upon the ridge 44 formed on the reflector pan 38. In a presently preferred embodiment, these switches 68 and 70 are diametrically opposed upon the ridge 44. In this manner if a fabric covers only a portion of a upper surface of the open pan 36 the elevated temperature will be detected by one or the other of the thermally activated switches 68 and 70 and will thereby interrupt the application of electrical power to the bulb 40.

Alternatively, an appropriate thermally activated switch 72 may be disposed by attaching the same to the lower surface which faces away from the bulb 40 of the reflector pan 38. The temperature at this position can also be preset and adjusted such that the switch 72 will be thermally activated at a time when the temperature in the lower portion of the pan 36 beneath the reflector pan is at a level to preclude the level of the temperature at the surface of the protector means from rising to a combustion level.

As is illustrated again in FIG. 6, the switches 68 and 70 may be affixed to the ridge 44 by appropriate fasteners inserted through the openings 74 and 76 to position the switches as shown in FIG. 3. On the other hand if the thermally activated switch 72 is to be utilized, fasteners would be inserted through the openings 78 and 80 to engage appropriate openings in the switch 72 and to hold it in place.

The switches employed may be of various types. These switches may be designed such that when there is a one time activation thereof they function as a fuse and cannot be reset or reactivated to subsequently apply power to the tungsten-halogen bulb. Alternatively, the switches may be designed such that they will cycle between the temperature at which the switch is activated to interrupt the application of electrical energy to the tungsten-halogen bulb and to a temperature which is sufficiently below the combustion level to permit the switch to again become closed to apply electrical energy to the bulb. With this type of switch the light bulb may be alternately off and on depending upon the temperature within the open pan 36. Yet a third alternative in accordance with the principals of the present invention would be to provide a switch such as that shown at 72 which includes a manual reset button 82 which may be disposed adjacent an orifice 84 in the surface of the pan 36. Under these circumstances, if the switch 72 becomes activated, the user may reset the switch by pressing the manual reset button 82. If desired, the orifice 84 may be covered by a protective member such as a plastic flexible member which may be depressed inwardly to reset the switch 72. Such a plastic member would eliminate the possibility of the user inserting foreign objects into the pan 36.

Figure 4:
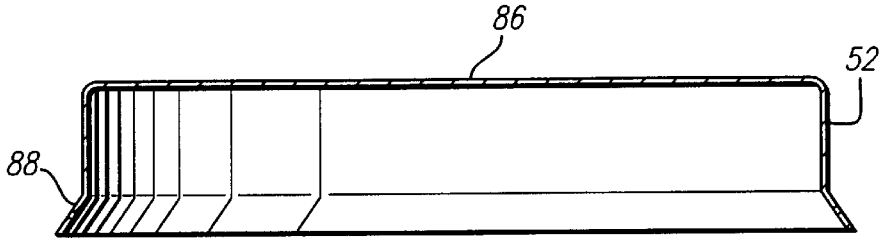
FIG. 4 is a cross-sectional view of one form of protector device.
Figure 5:
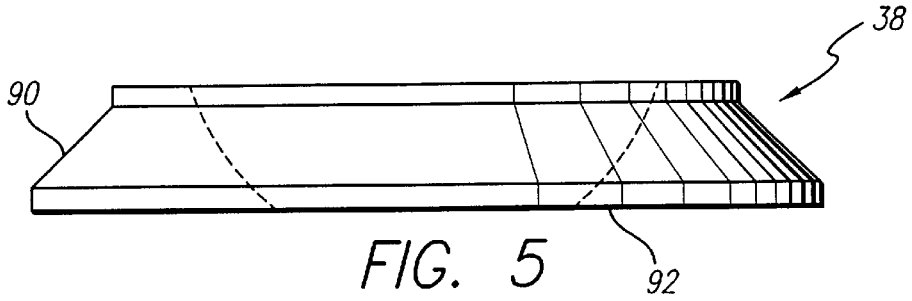
FIG. 5 is a front view of a reflector pan.

By reference now more particularly to FIG. 4, the protector member 52 is shown in greater detail. As therein shown, this member is a metallic mesh-like member which is formed in an inverted bowl shaped configuration so that the upper surface 86 thereof may be supported above the tungsten-halogen bulb. At the lower periphery, there is formed a flange 88 which is designed to engage the outer surface 90 of the reflector pan 38 so that it may be held in place by the fasteners 56 as shown in FIG. 3. The lower surface of the concave portion of the reflector pan which faces away from the halogen bulb is shown at 92 in FIGS. 5 and 6.

As above indicated, the protector means 34 may take various configurations and may be constructed of metal or glass. As is shown in FIG. 7, one such configuration may take the form of a mesh-like structure, such as the wire mesh 102 having a plurality of openings 94 which are formed throughout the upper surface 104 of the mesh-like structure. These openings 94 are arranged so that when the disc 104 as shown in FIG. 7 is affixed by appropriate fasteners passing through openings 98 and 100 in the periphery thereto to the lip 52 of the open pan 36 that they will be disposed perpendicular to the longitudinal axis of the tungsten-halogen bulb 40 as shown in FIG. 2. It has been determined that through the utilization of this type of structure there is little or no interference with the light passing through the openings 94. The structure as shown in FIG. 7 is particularly constructed for attachment as illustrated by the structure of FIG. 4.

Referring to FIG. 8, alternatively, the mesh-like structure may be an expanded metal structure 106 which includes a plurality of openings 108 which are formed throughout the upper 110 surface of the metal disc. The disc may be formed in a manner similar to that shown in FIG. 7 and attached in a generally similar manner. It has been found that through the utilization of an expanded metal structure 106 such as that shown in FIG. 8 that again the openings 108 provide sufficient unobstructed area for the light to pass therethrough as if the entire protective cover was transparent. One skilled in the art will recognize that the mesh-like structure is not limited to the wire mesh or expanded metal structure shown in FIGS. 7 and 8 and described herein. Rather, alternative embodiments of mesh-like structure may be used as well.

As is illustrated in FIG. 9, in yet another configuration, a metallic disc which includes a plurality of openings 1 12 which are formed throughout the upper surface 114 of the metal disc. The disc may be formed in a manner similar to that shown in FIG. 7 and attached in a generally similar manner. Through the utilization of an expanded metal structure such as that shown in FIG. 9, the openings 112 provide sufficient unobstructed area for the light to pass therethrough as if the entire protective cover was transparent.

It is believed that when the protective member is constructed of metal such as that shown at FIGS. 4, 7, 8 and 9, that the metal will also act as a heat conductor and will direct the heat generated by the tungsten-halogen lamp 40 to the reflector pan 38, thus creating a greater rise in temperature at the vicinity of the thermally activated switches to cause them to function prior to the time the temperature as the surface of the protector members reaches the undesired combustion temperature.

One skilled in the art will recognize that the present lamp including support means, upwardly directed open pan affixed to the support means and protector means disposed over the open pan to prevent foreign objects from coming into contact with the tungsten-halogen light bulb may be implemented on other types of lamp structures. For example, as is illustrated in FIG. 10, there is provided another embodiment of a stand-alone lamp 10 having a base 12 from which extends a hollow stem 14. The stem has a first end 16 which is rigidly and permanently affixed to the base 12 at approximately the center thereof. A second end 18 of the stem 14 is affixed to a general area lighting means 20 with the stem 14 being permanently affixed thereto at approximately the central portion thereof. Disposed between the base 12 and the general area lighting means 20 are a plurality of task lighting means such as task lights as illustrated at 22 and 24. Although only two task lights 22 and 24 are illustrated in FIG. 10, it should be understood by those skilled in the art that any number of task lights may be utilized as desired depending upon the particular application to which the stand-alone lamp is to be placed. Such multiplicity of task lights may be utilized for more specific applications such as reading or accent lighting of various items such as painting, sculptures or the like as may be desired. Electrical wiring (not shown) extends through the hollow stem 14 and provides electrical energy to lamps which are disposed within the general purpose lighting means 20 as well as the task lighting means 22 and 24. Switch means 28, 30 and 32 are provided to individually control the application of electrical energy to the lighting sources disposed within the lighting means 20, 22 and 24. The switch 28 is utilized to control the light source in the general purpose lighting means 20 and functions as a stem-mounted full dimmer switch which can turn the lamp in the general purpose lighting means 20 off and on as well as from full dim to full bright. The switches 30 and 32 are utilized to turn the light sources contained within the task lights 22 and 24 on or off and, alternatively, also may be two-way, three-way, or dimmer switches if such is desired. A protector means 34 is affixed to the open pan of the general area lighting means 20.

There has thus been disclosed a number of embodiments of safe general lighting means including a tungsten-halogen bulb designed to preclude the temperature at the surface from rising to a level such that fabric placed there over either inadvertently or purposefully will combust.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A stand alone electric lamp including a tungsten-halogen bulb light source comprising:

a base means for supporting said stand alone lamp on a surface;

an upwardly directed open pan;

a tungsten-halogen light bulb disposed within said pan;

a reflector means disposed within said pan for directing light generated by said bulb upwardly through said open pan;

stem means connected to said support means and said pan to dispose said pan above said surface and to direct light upwardly; and protector means disposed over said open pan to prevent foreign objects from coming into contact with said tungsten halogen light bulb, said protector means being substantially transparent to light from said bulb to allow said light to pass through said protector means in a substantially unobstructed fashion, said protector means being displaced from said bulb by an amount sufficient to preclude the temperature at said protector means from rising to a combustion level for fabric.

2. An electric lamp as defined in claim 1 in which said protector means is a metallic member defining spaced apart openings.

3. An electric lamp as defined in claim 2 wherein said metallic member is a mesh screen.

4. An electric lamp as defined in claim 2 wherein said metallic member is a plate-like member with parallel spaced apart strips defining said openings.

5. An electric lamp as defined in claim 2 wherein said metallic member is affixed to said pan.

6. An electric lamp as defined in claim 5 wherein said metallic member is formed with a convex surface facing said tungsten-halogen light bulb.

7. An electric lamp as defined in claim 1 in which said protector means is a glass member.

8. An electric lamp as defined in claim 7 wherein said glass member transmits light therethrough but reflects at least a portion of heat generated by said tungsten-halogen bulb into said pan.

9. An electric lamp as defined in claim 7 wherein said glass member is supported above said pan and provides space between said pan and said glass member peripherally thereof.

10. An electric lamp as defined in claim 1 wherein said reflector means is a reflector pan disposed within said pan, said reflector pan including socket means for receiving said tungsten-halogen light bulb.

11. An electric lamp as defined in claim 10 wherein said protector means is affixed to said reflector pan.

12. An electric lamp as defined in claim 11 in which said protector means is a metallic member defining spaced apart openings.

13. An electric lamp as defined in claim 12 wherein said metallic member is a mesh screen.

14. An electric lamp as defined in claim 13 wherein said metallic member is a plate-like member with parallel spaced apart strips.

15. An electric lamp as defined in claim 1 which further includes thermally activated switch means disposed within said open pan for interrupting the application of electrical energy to said tungsten-halogen light bulb when temperatures at said protector means reaches a predetermined level.

16. An electric lamp as defined in claim 15 wherein said switch means includes a thermal sensor.

17. An electric lamp as defined in claim 16 wherein said thermal sensor is a bimetallic member.

18. An electric lamp as defined in claim 15 wherein said switch means is resettable.

19. An electric lamp as defined in claim 16 wherein said reflector means is a reflector pan disposed within said open pan, said reflector pan including socket means for receiving said tungsten-halogen light bulb and wherein said switch means is mounted upon said reflector pan.

20. An electric lamp as defined in claim 19 wherein said reflector pan includes an annular ridge and said switch means is a pair of switches disposed at angularly displaced points upon said ridge.

21. An electric lamp as defined in claim 20 wherein said switches are diametrically disposed upon said ridge.

22. An electric lamp as defined in claim 19 wherein said reflector pan includes a bottom portion disposed below said tungsten-halogen light bulb and said switch means is disposed upon said bottom portion.

23. An electric lamp as defined in claim 22 wherein said bottom portion includes a first surface directed away from said tungsten-halogen light bulb and said switch means is mounted upon said first surface.

24. An electric lamp as defined in claim 23 wherein said switch means includes a reset member; said open pan defines an orifice therethrough; and said reset member being disposed to provide access thereto through said orifice.

25. An electric lamp as defined in claim 23 wherein said switch means cycles between an open position when said predetermined temperature is at a first level and a closed position when said temperature is at a second level less than said first level.

* * * * *